US007918550B2

(12) United States Patent
Bartlett et al.

(10) Patent No.: US 7,918,550 B2
(45) Date of Patent: Apr. 5, 2011

(54) MEMBRANE DIVIDED FOAM FOR USE IN AN INK JET CARTRIDGE

(75) Inventors: Robert Jason Bartlett, Lexington, KY (US); Renee Noel Lacy, Lexington, KY (US); Ryan S Reed, Lexington, KY (US); Herbert Gordon Toews, III, Versailles, KY (US); Jason David Williams, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 891 days.

(21) Appl. No.: 11/692,461

(22) Filed: Mar. 28, 2007

(65) Prior Publication Data

US 2008/0239032 A1 Oct. 2, 2008

(51) Int. Cl.
*B41J 2/175* (2006.01)

(52) U.S. Cl. ..... 347/87

(58) Field of Classification Search ..... 347/85, 347/86, 87

See application file for complete search history.

(56) References Cited

U.S. PATENT DOCUMENTS

| | | | | |
|---|---|---|---|---|
| 6,286,921 | B1 * | 9/2001 | Ochi et al. | 347/7 |
| 6,637,872 | B2 * | 10/2003 | Ara et al. | 347/85 |
| 6,742,881 | B2 * | 6/2004 | Kotaki et al. | 347/86 |
| 6,840,610 | B2 * | 1/2005 | Taniguchi et al. | 347/86 |
| 6,966,637 | B2 * | 11/2005 | Ishizaki | 347/85 |
| 7,261,402 | B2 * | 8/2007 | Taniguchi et al. | 347/86 |

* cited by examiner

*Primary Examiner* — Anh T. N. Vo

(57) ABSTRACT

Embodiment of the invention provide an ink jet cartridge for an ink jet printing device. In one embodiment, an ink jet cartridge can include a cartridge body operable to store ink jet printer ink for dispensing from the cartridge. The cartridge can further include at least one dispensing outlet operable to permit ink to be dispensed from the cartridge body. In addition, the cartridge can include a first foam portion positioned adjacent to the at least one dispensing outlet and operable to retain ink within the cartridge body until dispensed from the cartridge body. The cartridge can also include a second foam portion. Furthermore, the cartridge can include at least one membrane disposed between the first foam portion and the second foam portion, wherein the at least one membrane is operable to inhibit ink flow between the first foam portion and the second foam portion.

18 Claims, 4 Drawing Sheets

502

500
504

504
502
508
510
506
512
514

502
504
506
508
510
502
504
506
512

MEMBRANE DIVIDED FOAM FOR USE IN AN INK JET CARTRIDGE

FIELD OF THE INVENTION

The invention relates generally to ink jet printers, and more particularly, to membrane divided foam for use in an ink jet cartridge, and methods of using the same.

BACKGROUND OF THE INVENTION

Computer printers are well known in the prior art and include dot-matrix printers, piezo-electric ink jet printers, laser printers, thermal ink jet printers, handheld ink jet printers, and other ink jet printing devices. When using an ink jet printing device, an ink jet cartridge can be installed or otherwise mounted to the ink jet printing device to provide a supply of ink.

Ink supplies are often offered to customers at different price points, high yield cartridges container greater quantities of ink and cost ore, while low yield cartridges cost less, but provide less ink to the consumer. To simplify the manufacture of ink supplies, it is sometimes desirable to use the same or a similar-sized cartridge housing for both the high yield and low yield cartridges. As a result, low yield cartridges are sometimes shipped partially filled, which can lead to several problems. In such instances, vibration and environment changes can cause ink to migrate throughout the interior body of the ink jet cartridge such that the ink becomes overly dispersed within the interior body of the ink jet cartridge. In these instances, problems such as depriming and starvation can occur when an insufficient amount of ink is available for dispensing from the ink jet cartridge.

To facilitate lower yield volumes for ink jet cartridges, one conventional ink jet cartridge can include one or more interior walls within the interior body of the ink jet cartridge. In such instances, relatively small interior compartments can be created within the cartridge. In this manner, a relatively small amount of ink can be compartmentalized within the ink jet cartridge, and the ink can be dispensed from an adjacent outlet in the cartridge. However, manufacturing these conventional ink jet cartridges can require retooling the associated manufacturing or assembly processes or otherwise providing a special mold to provide unique geometry and chamber size within the interior body of the ink jet cartridge. Retooling such processes can be time consuming and expensive, particularly when production demand shifts between low and high ink volumes for ink jet cartridges.

SUMMARY OF THE INVENTION

Some or all of the above needs can be addressed by some or all of the embodiments described herein. According to one embodiment of the invention, an ink jet cartridge for an ink jet printing device can include a cartridge body operable to store ink jet printer ink for dispensing from the cartridge. In addition, the cartridge can include at least one dispensing outlet operable to permit ink to be dispensed from the cartridge body. Furthermore, the cartridge can include a first foam portion positioned adjacent to the at least one dispensing outlet and operable to retain ink within the cartridge body until dispensed from the cartridge body. In addition, the cartridge can include a second foam portion. Furthermore, the cartridge can include at least one membrane disposed between the first foam portion and the second foam portion, wherein the at least one membrane is operable to inhibit ink flow between the first foam portion and the second foam portion.

In one aspect of this embodiment, the first foam portion is mounted to one side of the at least one membrane, and the second foam portion is mounted to another side of the at least one membrane.

In another aspect of this embodiment, the first foam portion is hear laminated to one side of the at least one membrane, and the second foam portion is heat laminated to another side of the at least one membrane.

In yet another aspect of this embodiment, the first foam portion comprises at least one of the following: polyurethane, polyester, polyether, polyolefin, a reticulated foam-type material, an unreticulated foam-type material, a felted foam-type material, or an unfelted foam-type material.

In yet another aspect of this embodiment, the second foam portion comprises at least one of the following: polyurethane, polyester, polyether, polyolefin, a reticulated foam-type material, an unreticulated foam-type material, a felted foam-type material, or an unfelted foam-type material.

In yet another aspect of this embodiment, the at least one membrane comprises at least one of the following: polyolefin, polypropylene, polyethylene, polyvinylchloride, or acetate.

According to another embodiment of the invention, a method for operating an ink jet cartridge for an ink jet printing device can include providing an ink jet cartridge. The ink jet cartridge can include at least one dispensing outlet operable to permit ink to be dispensed from the ink jet cartridge. In addition, the ink jet cartridge can include a first foam portion positioned adjacent to the at least one dispensing outlet and operable to retain ink within the cartridge body until dispensed from the cartridge body. The ink jet cartridge can also include a second foam portion. Furthermore, the ink jet cartridge can include at least one membrane disposed between the first foam portion and the second foam portion, wherein the at least one membrane is operable to inhibit ink flow between the first foam portion and the second foam portion. The method can further include mounting the ink jet cartridge in an ink jet printing device, and dispensing ink from the at least one dispensing outlet onto a material.

In one aspect of this embodiment, the first foam portion is mounted to one side of the at least one membrane, and the second foam portion is mounted to another side of the at least one membrane.

In another aspect of this embodiment, the first foam portion is heat laminated to one side of the at least one membrane, and the second foam portion is heat laminated to another side of the at least one membrane.

In yet another aspect of this embodiment, the first foam portion comprises at least one of the following: polyurethane, polyester, polyether, polyolefin, a foam, a reticulated foam-type material, an unreticulated foam-type material, a felted foam-type material, or an unfelted foam-type material.

In yet another aspect of this embodiment, the second foam portion comprises at least one of the following: polyurethane, polyester, polyether, polyolefin, a foam, a reticulated foam-type material, an unreticulated foam-type material, a felted foam-type material, or an unfelted foam-type material.

In yet another aspect of this embodiment, the at least one membrane comprises at least one of the following: polyolefin, polypropylene, polyethylene, polyvinylchloride, or acetate.

According to another embodiment of the invention, a method for assembling an ink jet cartridge for an ink jet printing device can include providing a cartridge body. The cartridge body can be operable to store ink jet printer ink for dispensing from the cartridge body, wherein the cartridge body comprises at least one dispensing outlet operable to permit ink to be dispensed from the cartridge body. Furthermore, the method can include mounting a first foam portion to one side of at least one membrane, wherein the first foal portion is operable to retain ink within the cartridge body until dispensed from the cartridge body. The method can also include mounting a second foam portion is another side of the at least one membrane. In addition, the method can include disposing the first foam portion, the at least one membrane, and second foam portion within the cartridge body, wherein the first foam portion is positioned adjacent to the at least one dispensing outlet and operable to retain ink within the cartridge body until dispensed from the cartridge body, and wherein the at least one membrane is operable to inhibit ink flow between the first foam portion and the second foam portion.

In one aspect of this embodiment, the method can further include inserting ink into the cartridge body, wherein the ink is retained within the first foam portion.

In another aspect of this embodiment, the first foam portion is heat laminated to one side of the at least one membrane, and the second foam portion is heat laminated to another side of the at least one membrane.

In yet another aspect of this embodiment, the first foam portion comprises at least one of the following: polyurethane, polyester, polyether, polyolefin, a foam, a reticulated foam-type material, an unreticulated foam-type material, a felted foam-type material, an unfelted foam-type material, or any combination thereof.

In yet another aspect of this embodiment, the second foam portion comprises at least one of the following: polyurethane, polyester, polyether, polyolefin, a foam, a reticulated foam-type material, an unreticulated foam-type material, a felted foam-type material, an unfelted foam-type material, or any combination thereof.

In yet another aspect of this embodiment, the at least one membrane comprises at least one of the following: polyolefin, polypropylene, polyethylene, polyvinylchloride, or acetate.

According to yet another embodiment of the invention, an apparatus for an ink jet cartridge for an ink jet printing device can include a first foam portion positioned adjacent to a dispensing outlet of an ink jet cartridge and operable to retain ink within the ink jet cartridge until dispensed from the ink jet cartridge. The apparatus can also include a second foam portion. In addition, the apparatus can include at least one membrane disposed between the first foam portion and the second foam portion, wherein the at least one membrane is operable to inhibit ink flow between the first foam portion and the second foam portion when the first foam portion and second foam portion are disposed within an ink jet cartridge.

In one aspect of this embodiment, the first foam portion is mounted to one side of the at least one membrane, and the second foam portion is mounted to another side of the at least one membrane.

In another aspect of this embodiment, the first foam portion is heat laminated to one side of the at least one membrane, and the second foam portion is heat laminated to another side of the at least one membrane.

In yet another aspect of this embodiment, the first foam portion comprises at least one of the following: polyurethane, polyester, polyether, polyolefin, a foam, a reticulated foam-type material, an unreticulated foam-type material, a felted foam-type material, or an unfelted foam-type material.

In yet another aspect of this embodiment, the second foam portion comprises at least one of the following: polyurethane, polyester, polyether, polyolefin, a foam, a reticulated foam-type material, an unreticulated foam-type material, a felted foam-type material, or an unfelted foam-type material.

In another aspect of this embodiment, the at least one membrane comprises at least one of the following: polyolefin, polypropylene, polyethylene, polyvinylchloride, or acetate.

Other systems, processes, and apparatus according to various embodiments of the invention will become apparent with respect to the remainder of this document.

BRIEF DESCRIPTION OF THE DRAWINGS

Figure 1:
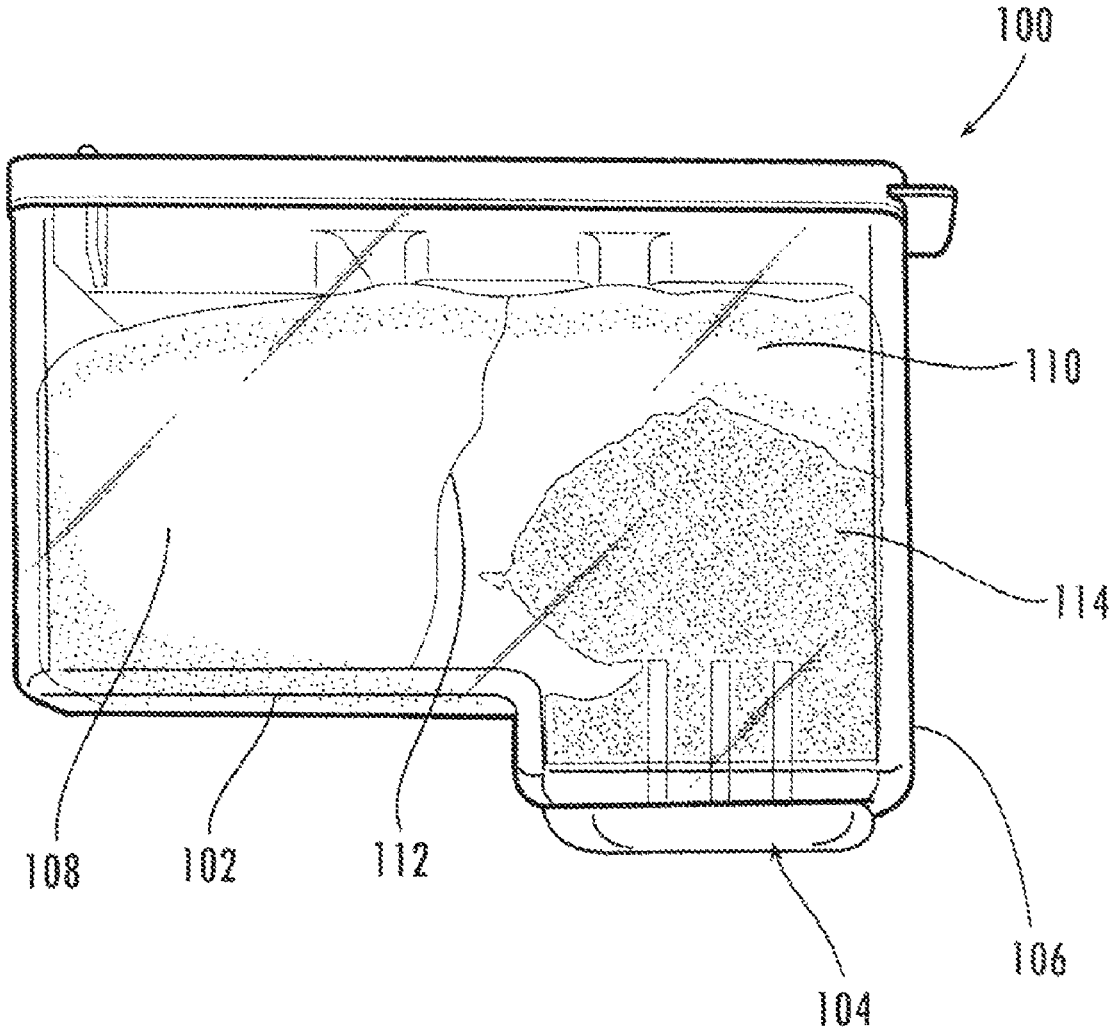

Having thus described the invention in general terms, reference will now be made to the accompanying drawings, which are not necessarily drawn to scale, and wherein:

FIG. 1 shows a perspective view of an example ink jet cartridge for an ink jet printing device, according to an illustrative embodiment of the invention.

Figure 2:
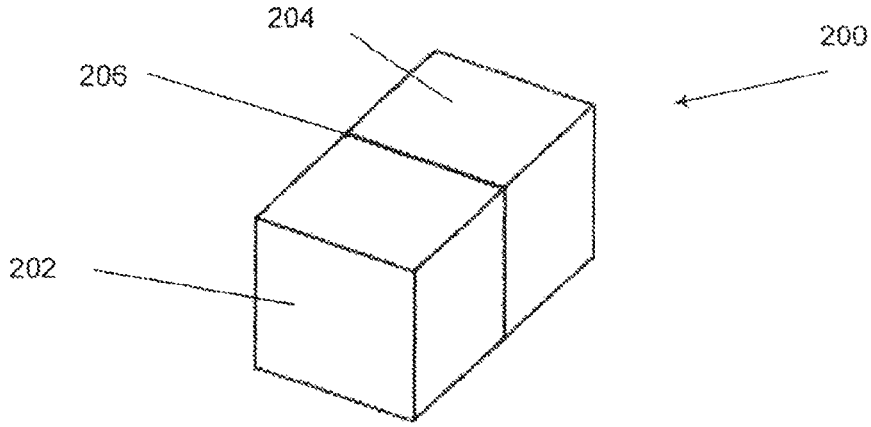

FIG. 2 shows a perspective view of an example apparatus for an ink jet cartridge, according to an illustrative embodiment of the invention.

Figure 3:
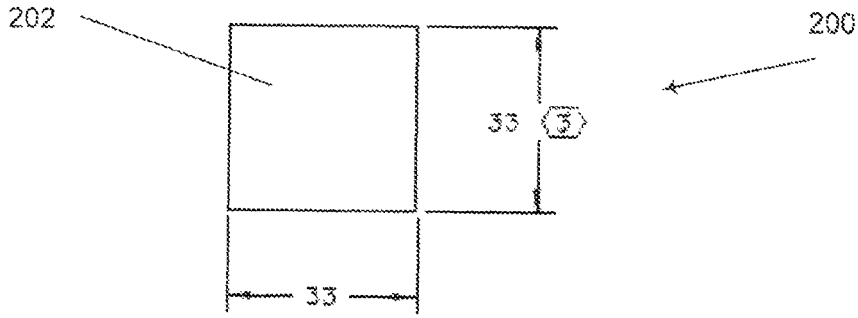

FIG. 3 shows an end view of the example apparatus shown in FIG. 2.

Figure 4:
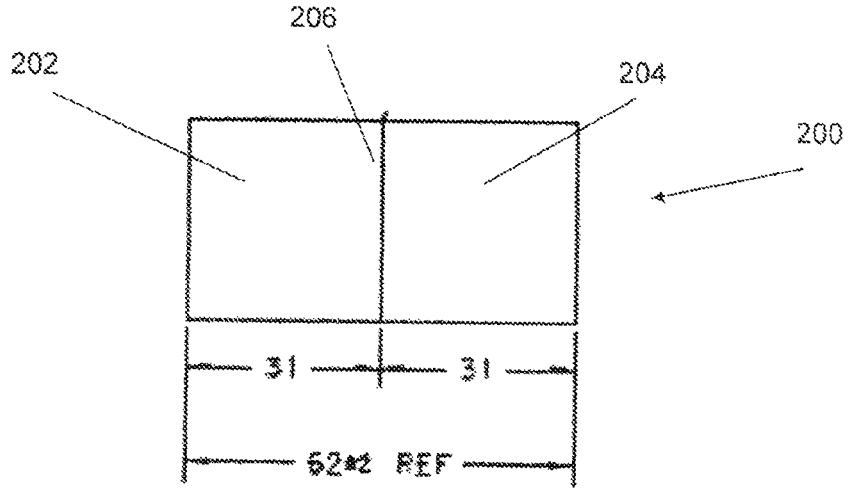

FIG. 4 shows a side view of the example apparatus shown in FIG. 2.

FIGS. 5A-D illustrate example methods for assembling an example ink jet cartridge for an ink jet printing device, and for assembling an example apparatus for an ink jet cartridge, according to illustrative embodiments of the invention.

Figure 6:
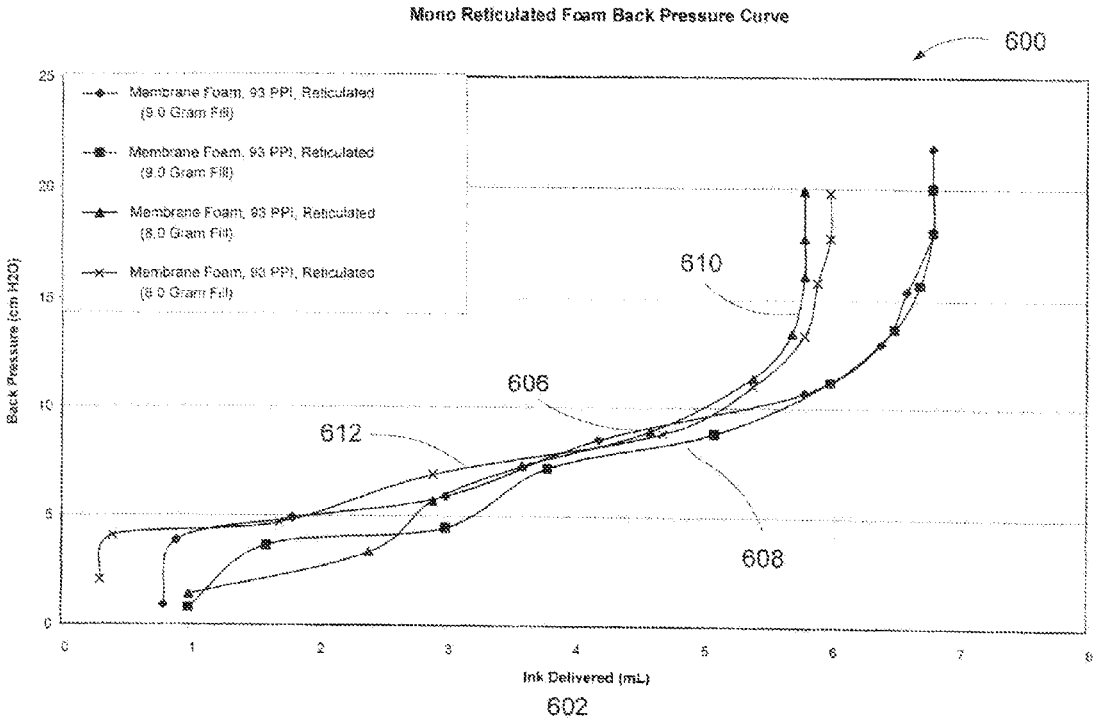

FIG. 6 illustrates an example set of test data for ink jet cartridges according to illustrative embodiment of the invention.

DETAILED DESCRIPTION OF EMBODIMENTS OF THE INVENTION

Embodiment of the invention now will be described more fully hereinafter with reference to the accompanying drawings. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 shows a perspective view of an example ink jet printer cartridge 100, according to an embodiment of the invention. The example ink jet printer cartridge 100 shown in FIG. 1 includes a cartridge body 102. The cartridge body 102 can include a relatively durable compartment or container for mounting within or to an ink jet printing device and for dispensing an ink jet ink in a printing application. The ink jet printer cartridge 100 can also include one or more dispensing outlets 104 for dispensing ink from the cartridge body 102. As shown, the dispensing outlets 104 can be oriented to permit ink within the cartridge body 102 to be dispensed from a particular portion of the body 102, such as an extended printer head portion 106. Shown within the cartridge 100, a first foam portion 110 and second foam portion 108 are disposed on opposing sides of a membrane 112. Generally, the membrane 112 can separate the first foam portion 110 and the second foam portion 108 when both foam portions 108, 110 are disposed within the cartridge body 102. Alternatively, the membrane 112 can separate the cartridge body 102 into two or more regions with the first foam portion 110 in one region and the second foam portion 108 in another region of the cartridge body 102. In this example, the first foam portion 110 can be oriented adjacent to the dispensing outlets 104 and extended printer head portion 106, while the second foam portion 108 can be oriented away from the dispensing outlets 104. In this manner ink jet 114 can be maintained and dispensed from a particular portion of the cartridge body 102, specifically from a region adjacent to the dispensing outlets 104 and extended printer head portion 106. For instance, a suitable back pressure can be generated by the internal configuration of the ink jet cartridge 100 capable of maintaining ink 114 within the cartridge body 102 until dispensed. An associated ink jet printing device (not shown) can interact with the ink jet printing cartridge 100 and dispense ink jet ink 114 from the cartridge body 102 in a printing application as needed.

Other embodiments can include different configurations and numbers of foam portions and membranes disposed within a cartridge body of an ink jet printer cartridge in accordance with other embodiments of the invention.

In one embodiment, a suitable first foam portion can include reticulated polyurethane, or any other foam-type material operable to retain an ink jet ink within an ink jet cartridge. One example of a suitable first foam portion is an unfelted, approximately 93 ppi (pores per inch), reticulated charcoal, polyether-polyurethane foam. Other suitable materials for a first foam portion can include, but are not limited to, polyester, polyether, polyolefin, a foam, a reticulated foam-type material, an unreticulated foam-type material, a felted foam-type material, an unfelted foam-type material, or any combination thereof.

In one embodiment, a suitable second foam portion can include reticulated polyurethane, or any other foam-type material operable to retain an ink jet ink within an ink jet cartridge. One example of a suitable second foam portion is an unfelted, approximately 93 ppi, reticulated charcoal, polyether-polyurethane foam. Other suitable materials for a second foam portion can include, but not limited to, polyester, polyether, polyolefin, a foam, a reticulated foam-type material, an unreticulated foam-type material, a felted foam-type material, an unfelted foam-type material, or any combination thereof.

In one embodiment, a suitable membrane can include polyolefin, polypropylene, polyethylene, or any other flexible-type material operable to separate regions within an ink jet cartridge and further operable to inhibit ink flow between a first region and a second region within an ink jet cartridge. One example of a suitable membrane is a polyolefin membrane. Other suitable materials for a membrane can include, but are not limited to, polypropylene, polyethylene, polyvinylchloride, or acetate.

In one embodiment, the first foam portion and second foam portion can each be heat laminated to opposing sides of the membrane. In other embodiments, the membrane may be sufficiently mounted to both the first foal portion and second foam portion using a suitable amount of heat and/or pressure. In yet other embodiments, the membrane may be sufficiently mounted to both the first foam portion and the second foam portion using either or both a heat lamination process and a suitable adhesive.

In one embodiment, the first foam portion and the second foam portion can be different types of foam or materials mounted to opposing sides of a membrane.

In one embodiment, the ink within an ink jet cartridge, such as ink 114 in cartridge 100 shown in FIG. 1, can have a back pressure of approximately 2 to 3 cm (0.787 to 1.181 inches) of water when the cartridge is assembled and ink is stored inside the cartridge for subsequent dispensing.

FIG. 2 shows a perspective view of an example apparatus 200 for an ink jet cartridge 100. FIG. 3 shows an end view of the example apparatus shown in FIG. 2, and FIG. 4 shows a side view of the example apparatus shown in FIG. 2. The example apparatus 200 shown in FIGS. 2-4 includes a first foam portion 202, a second foam portion 204, and a membrane 206. In this example, the first foam portion 202 and second portion 204 are disposed on opposing sides of the membrane 206. The first foam portion 202 and the second foam portion 204 are each mounted or heat laminated to the membrane 206. In at least one embodiment, the first foam portion 202 and second foam portion can be mounted to the membrane 206 using a suitable adhesive. In yet another embodiment, the membrane may be sufficiently mounted to both the first foam portion and the second foam portion using both a heat lamination process and a suitable adhesive. Generally, the membrane 206 can separate the first foam portion 202 from the second foam portion 204 when the apparatus 200 is disposed within an ink jet printer cartridge, such as 100 in FIG. 1.

The first foam portion 202 is shown as a rectangular-shaped polygon. In one embodiment, a suitable first foam portion can include reticulated polyurethane, or any other foam-type material operable to retain an ink jet ink within an ink jet cartridge. One example of a suitable first foam portion is an unfelted, approximately 93 ppi, reticulated charcoal, polyether-polyurethane foam with the approximate dimensions of 31 millimeters (mm) (1.22 inches×33 mm (1.30 inches)×33 mm (1.30 inches). Other embodiment of a first foam portion can have different shapes, sizes, an material composition depending on the size and shape of the ink jet cartridge and the type of ink to be used with the first foam portion. Other suitable materials for a first foam portion can include, but are not limited to, polyester, polyether, polyolefin, a foam, a reticulated foam-type material, an unreticulated foam-type material, a felted foam-type material, an unfelted foam-type material, or any combination thereof.

The second foam portion 204 is shown as a rectangular-shaped polygon. In one embodiment, a suitable second foam portion can include reticulated polyurethane, or any other foam-type material operable to retain an ink jet ink within an ink jet cartridge. One example of a suitable second foam portion is an unfelted, approximately 93 ppi, reticulated charcoal, polyether-polyurethane foam with the approximate dimensions of 31 millimeters (mm) (1.22 inches)×33 mm (1.30 inches)×33 mm (1.30 inches). Other embodiments of a second foam portion can have different shapes, sizes, and material compositions depending on the size and shape of the ink jet cartridge, and the type of ink to be used with the second foam portion. Other suitable materials for a second foam portion can include, but are not limited to, polyester, polyether, polyolefin, a foam, a reticulated foam-type material, an unreticulated foam-type material, a felted foam-type material, an unfelted foam-type material, or any combination thereof.

In one embodiment, the first foam portion 202 and the second foam portion 204 can be different types of foam or materials.

The membrane 206 is shown as a relatively thin, rectangular-shaped structure. In one embodiment, a suitable membrane can include polyolefin, polypropylene, polyethylene, or any other flexible-type material operable to separate regions within an ink jet cartridge and further operable to inhibit ink flow between a first region and a second region within an ink jet cartridge. One example of a suitable membrane is a polyolefin membrane with the approximate dimensions of 33 millimeters (mm) (1.30 inches)×33 mm (1.30 inches)×0.05 mm (0.0020 inches). Other embodiments of a membrane can have different shapes, sizes, and material compositions depending on the size and shape of the ink jet cartridge, and the type of ink to be used with the membrane. Other suitable materials for a membrane can include, but are not limited to, polypropylene, polyethylene, polyvinylchloride, or acetate.

In the embodiment shown, the foam portions 202, 204 can be mounted to opposing sides of the membrane 206 using a heat lamination process. In other embodiments, a suitable adhesive can be applied between the membrane 206 and each of the foam portions 202, 204. In one embodiment, a suitable adhesive can include any adhesive-type material operable to mount a first or second foam portion to one side of a membrane. In another embodiment, the membrane 206 may be sufficiently mounted to both the first foam portion 202 and second foam portion 204 using a suitable amount of heat and/or pressure. In other embodiments, other mounting techniques, laminates, adhesives, or other devices can be used to mount each from portion to a side of a membrane.

FIGS. 5A-D illustrate an example method for assembling an ink jet cartridge for an ink jet printing device, or otherwise assembling an apparatus for an ink jet cartridge, according to illustrative embodiments of the invention. The ink jet cartridge and apparatus shown in FIGS. 5A-D is similar to the cartridge 100 described in FIG. 1, and apparatus 200 in FIGS. 2-4.

Figures 5A, 5B, 5C, 5D:
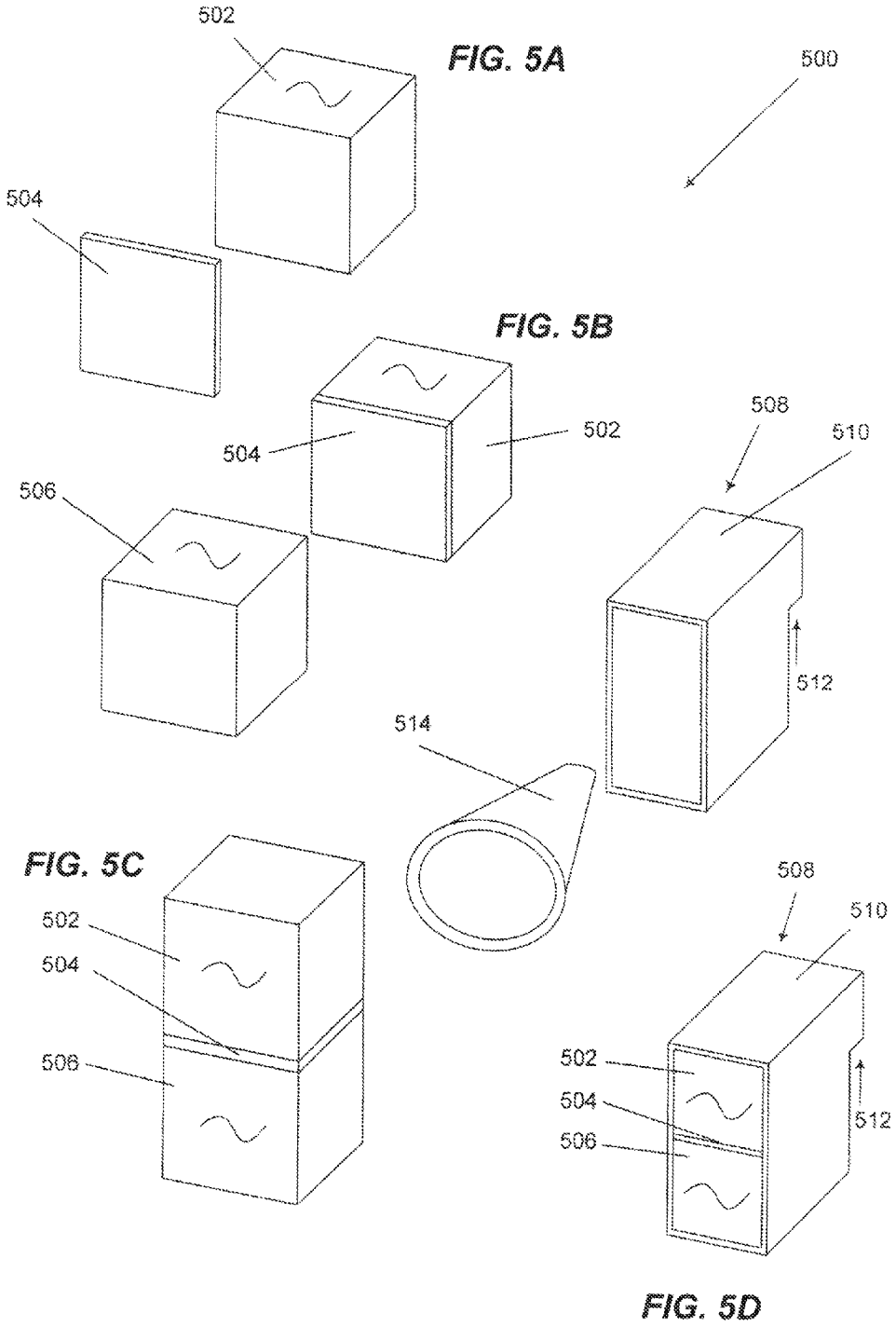

The method 500 begins in FIG. 5A, where a first foam portion 502, similar to 108 in FIG. 1, is mounted to one side of a membrane 504, similar to 112. The first foam portion 504 is operable to retain ink within a printer cartridge body until dispensed from the printer cartridge body, and the membrane 504 can be operable to inhibit ink flow between the one portion of a printer cartridge body and another portion of the printer cartridge body. In this example, the first foam portion can be reticulated polyurethane, and the member can be polyethylene.

In one embodiment, a heat lamination process can be used to mount the first foam portion 502 to one side of the membrane 504. For example, a suitable amount of heat can be applied to either or both the first foam portion 502 and one side of the membrane 504. In another example, a suitable adhesive can be applied between the first foam portion 502 and one side of the membrane 504. In either instance, an appropriate amount of heat and/or pressure may be applied such that the membrane 504 and the foam portion 502 mount to each other, or otherwise activate the adhesive to permit the first foam portion 502 to substantially adhere to the one side of the membrane 504. In another embodiment, the membrane 504 may be sufficiently mounted to both the first foam portion 502 and second foam portion 506 using a suitable amount of hear and/or pressure. In other embodiments, other mounting techniques, laminates, adhesives, or other devices can be used to mount a first foam portion to one side of a membrane.

In FIG. 5B, a second foam portion 506, similar to 106 in FIG. 1, is mounted to another side of the membrane 504. In this example, the second foam portion can be reticulated polyurethane.

In one embodiment, a heat lamination process can be used to mount the second foam portion 506 to another side of the membrane 504. For example, a suitable amount of heat can be applied to either or both the second foam portion 506 and another side of the membrane 504. In another example, a suitable adhesive can be applied between the second foam portion 506 and one side of the membrane 504. In either instance, an appropriate heat and/or pressure may be applied such that the membrane 504 and the foam portion 506 mount to each other, or otherwise to activate the adhesive to permit the second portion 506 to substantially adhere to the other side of the membrane 504. In other embodiments, other mounting techniques, laminates, adhesives, or other devices can be used to mount a second foam portion to one side of a membrane.

In one embodiment, the combination of the first foam portion 502, membrane 504, and second foam portion 506 comprises an apparatus for an ink jet printer cartridge, such as printer cartridge 508.

In FIG. 5C, an ink jet printer cartridge 508, similar to 100 in FIG. 1, with a cartridge body 510, similar to 102 in FIG. 1, is provided. The cartridge body 510 shown can be operable to store ink jet printer ink for dispensing from the cartridge 510. In this example, the cartridge body 510 can include at least one dispensing outlet 512, similar to 104, operable to permit ink to be dispensed from the cartridge body 510. As shown in FIG. 5C, a funnel 514 and/or other insertion tools can be used to dispose the assembled first foam portion 502, the membrane 504, and second foam portion 506, or apparatus, within the cartridge body 510, wherein the first foam portion 502 is positioned adjacent to the at least one dispensing outlet 512. Appropriate pressure or force may be needed to compress and manipulate the first foam portion 502, the membrane 504, and second foam portion 506 into and through the funnel 514 for insertion into the cartridge body 510. In other embodiments, other insertion tools, devices, or techniques can be use to dispose a first foam portion 502, a membrane 504, and a second foam portion 506 within a cartridge body 510.

In the embodiment shown in FIG. 5C, an upper portion of the cartridge body 510 has been removed to permit insertion of the assembled first foam portion 502, the membrane 504, and second foam portion 506, or apparatus, within the cartridge body 510. The assembled first foam portion 502, the membrane 504, and second foam portion 506, or apparatus, can be rotated, compressed, or otherwise manipulated as needed to fit within the cartridge body 510. In other embodiments of the invention, relatively smaller, larger, or other portions of the cartridge body 510 can be removed, or a relatively small opening can be used, to insert the apparatus into the cartridge body 510.

As shown in FIG. 5D, the assembled first foam portion 502, the membrane 504, and second foam portion 506, or apparatus, can be disposed within the cartridge body 510. In this embodiment, the first foam portion 502 is shown adjacent to the at least one dispensing outlet 512. In this manner the first foam portion 502 will be operable to retain ink within the cartridge body 510 until dispensed from the cartridge body 510, and the membrane 504 will be operable to inhibit ink flow between the first foam portion 502 and the second foam portion 506.

In one embodiment, an additional element of the method 500 can be inserting ink, similar to 114 to FIG. 1, into the cartridge body 510, wherein the ink can be retained within the first foam portion 502. In this example, the ink can be an ink suitable for use as an ink jet printer ink. Generally, after insertion of the apparatus and ink into the cartridge body 510, the body 510 can be sealed or otherwise closed. In the example shown, a corresponding upper portion can be mounted to the cartridge body 510, and the cartridge body 510 can be sealed or closed.

Other methods for assembling an ink jet cartridge for an ink jet printing device, or otherwise assembling an apparatus for an ink jet cartridge, can include some or all of the above elements as well as other elements in accordance with the invention.

FIG. 6 illustrates an example set of test data for ink jet cartridges according to an illustrative embodiment of the invention. The ink jet cartridges from which the test data 600 was collected from are similar to the cartridges 100, 200 described in FIGS. 1-4. The data 600 is shown graphed with respect to an x-axis 602 representing ink delivered measured in milliliters (ml) ranging from approximately 0 to 8, and a y-axis 604 representing back pressure measured in centimeters of water ranging from approximately 0 to 25. A first curve 606 represents a data set measured for an ink jet cartridge containing a 18C series mono reticulated membrane foam with approximately 93 ppi and filled with approximately 9.0 grams of ink. The second curve 608 represents a data set measured for an ink jet cartridge containing a 18C series mono reticulated membrane foam with approximately 93 ppi and filled with approximately 9.0 grams of ink. Generally, the first curve 606 and second curve 608 slope upward on the graph, and each has a slightly less steep slope than data curves 610 and 612. The third curve 610 and fourth curve 612 each represent a data set measured for an ink jet cartridge containing a 18C series mono reticulated membrane foam with approximately 93 ppi and filled with approximately 8.0 grams of ink. The third curve 610 and fourth curves 610 and 612 have similar upward slopes on the graph, but each has a slightly greater slope than data curves 606, 608. In all instances shown, a quantity of ink can be dispensed from the ink jet cartridges tested before the back pressure dramatically increases, indicating the ink level within the cartridge is nearing or has reached exhaustion. In this manner, desired yield targets in terms of the number of pages printed using each ink jet printer cartridge can be compared by reference to some or all of the curves shown in FIG. 6.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention that is claimed is:

1. An ink jet cartridge for an ink jet printing device, the cartridge comprising:

a cartridge body operable to store ink jet printer ink for dispensing from the cartridge;

a dispensing outlet in an extended head portion of the cartridge body operable to permit the ink to be dispensed from the cartridge body;

a first foam portion positioned immediately adjacent to the dispensing outlet in the extended head portion and operable to retain the ink within the cartridge body in fluid communication with the dispensing outlet until dispensed from the cartridge body;

a second foam portion; and at least one membrane permanently disposed between the first foam portion and the second foam portion, wherein the at least one membrane is operable to inhibit ink flow between the first foam portion and the second foam portion during printing such that the second foam portion is prevented by the membrane from receiving fluid, the first and second foam portions residing laterally in a common compartment in the cartridge body under a common lid.

2. The ink jet cartridge of claim 1, wherein the first foam portion is mounted to one side of the at least one membrane, and the second foam portion is mounted to another side of the at least one membrane.

3. The ink jet cartridge of claim 1, wherein the first foam portion is heat laminated to one side of the at least one membrane, and the second foam portion is heat laminated to another side of the at least one membrane.

4. The ink jet cartridge of claim 1, wherein the first foam portion comprises at least one of the following: polyurethane, polyester, polyether, polyolefin, a foam, a reticulated foam-type material, an unreticulated foam-type material, a felted foam-type material, or an unfelted foam-type material.

5. The ink jet cartridge of claim 1, wherein the second foam portion comprises at least one of the following: polyurethane, polyester, polyether, polyolefin, a foam, a reticulated foam-type material, an unreticulated foam-type material, a felted foam-type material, or an unfelted foam-type material.

6. The ink jet cartridge of claim 1, wherein the at least one membrane comprises at least one of the following: polyolefin, polypropylene, polyethylene, polyvinylchloride, or acetate.

7. A method for assembling an ink jet cartridge for an ink jet printing device using a cartridge body to store ink jet printer ink for dispensing from the cartridge, the cartridge body having at least one dispensing outlet operable to permit the ink to be dispensed from the ink jet cartridge, the method comprising:

mounting a first foam portion to one side of at least one membrane, wherein the first foam portion is operable to retain ink within the cartridge body until dispensed from the cartridge body;

mounting a second foam portion to another side of the at least one membrane; and disposing the first foam portion, the at least one membrane, and second foam portion in a common compartment under a common lid within the cartridge body, wherein the first foam portion is positioned immediately adjacent to the at least one dispensing outlet and operable to retain the ink within the cartridge body until dispensed from the cartridge body, and wherein the at least one membrane is permanently operable during printing to inhibit ink flow between the first foam portion and the second foam portion.

8. The method of claim 7, further comprising:

inserting the ink into the cartridge body, wherein the ink is only retained within the first foam portion.

9. The method of claim 7, wherein the first foam portion is heat laminated to one side of the at least one membrane, and the second foam portion is heat laminated to another side of the at least one membrane.

10. The method of claim 7, wherein the first foam portion comprises at least one of the following: polyurethane, polyester, polyether, polyolefin, a foam, a reticulated foam-type material, an unreticulated foam-type material, a felted foam-type material, or an unfelted foam-type material.

11. The method of claim 7, wherein the second foam portion comprises at least one of the following: polyurethane, polyester, polyether, polyolefin, a foam, a reticulated foam-type material, an unreticulated foam-type material, a felted foam-type material, or an unfelted foam-type material.

12. The method of claim 7, wherein the at least one membrane comprises at least one of the following: polyolefin, polypropylene, polyethylene, polyvinylchloride, or acetate.

13. An apparatus for an ink jet cartridge for an ink jet printing device, the apparatus comprising:

a first foam portion positioned immediately adjacent to a dispensing outlet of an ink jet cartridge and operable to retain ink within the ink jet cartridge until dispensed from the ink jet cartridge;

a second foam portion; and at least one membrane permanently disposed between the first foam portion and the second foam portion during printing, wherein the at least one membrane is operable to inhibit ink flow between the first foam portion and the second foam portion when the first foam portion and second foam portion are disposed within a common ink compartment under a common lid in an ink jet cartridge.

14. The apparatus of claim 13, wherein the first foam portion is mounted to one side of the at least one membrane, and the second foam portion is mounted to another side of the at least one membrane.

15. The apparatus of claim 13, wherein the first foam portion is heat laminated to one side of the at least one membrane, and the second foam portion is heat laminated to another side of the at least one membrane.

16. The apparatus of claim 13, wherein the first foam portion comprises at least one of the following: polyurethane, polyester, polyether, polyolefin, a foam, a reticulated foam-type material, an unreticulated foam-type material, a felted foam-type material, or an unfelted foam-type material.

17. The apparatus of claim 13, wherein the second foam portion comprises at least one of the following: polyurethane, polyester, polyether, polyolefin, a foam, a reticulated foam-type material, an unreticulated foam-type material, a felted foam-type material, or an unfelted foam-type material.

18. The apparatus of claim 13, wherein the at least one membrane comprises at least one of the following: polyolefin, polypropylene, polyethylene, polyvinylchloride, or acetate.

* * * * *